US010025259B2

(12) United States Patent
Doi et al.

(10) Patent No.: US 10,025,259 B2
(45) Date of Patent: Jul. 17, 2018

(54) IMAGE FORMING APPARATUS HAVING A DAMPER UNIT WHICH REGULATES MOVEMENT OF A DOOR UNIT

(71) Applicant: CANON KABUSHIKI KAISHA, Tokyo (JP)

(72) Inventors: Shigeo Doi, Toride (JP); Tadahisa Sugiyama, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/876,170

(22) Filed: Oct. 6, 2015

(65) Prior Publication Data

US 2016/0102488 A1 Apr. 14, 2016

(30) Foreign Application Priority Data

Oct. 14, 2014 (JP) ..... 2014-209736

(51) Int. Cl.
*G03G 21/16* (2006.01)
*E05F 5/06* (2006.01)
(Continued)

(52) U.S. Cl.
CPC ..... *G03G 21/1633* (2013.01); *E05D 15/30* (2013.01); *E05F 3/14* (2013.01);
(Continued)

(58) Field of Classification Search
CPC ... G03G 21/1633; G03G 21/1638; E05F 5/06; E05F 3/14; E05F 3/20; E05D 15/30
(Continued)

(56) References Cited

U.S. PATENT DOCUMENTS 4,260,189 A * 4/1981 Periou ..... B60J 7/053 296/223
5,061,023 A * 10/1991 Soubliere ..... E05D 1/04 16/355
(Continued)

FOREIGN PATENT DOCUMENTS

EP 1 503 111 * 2/2005
EP 1 577 103 A2 9/2005
(Continued)

OTHER PUBLICATIONS

Search Report and Written Opinion in Singapore Patent Application No. 10201508270W, dated Dec. 30, 2015.
(Continued)

*Primary Examiner* — Gregory J Strimbu
(74) *Attorney, Agent, or Firm* — Fitzpatrick, Cella, Harper & Scinto

(57) ABSTRACT

An image forming apparatus includes a main body, a door unit, and a loading portion that applies a load affecting movement of the door unit. The loading portion includes a rotating member, a damper unit, and an arm portion, which engages with the rotating member to extend and retract along an arc. The damper unit applies the load to the moving door unit such that, when a first arm member of the arm portion is engaged with the rotating member, the door unit can move to a first position at a first opening angle, and when a second arm member of the arm portion is engaged with the rotating member, the door unit can move to a second position at a second opening angle which is greater than the first opening angle. The first and second arm members move relative to each other with movement of the door unit.

21 Claims, 14 Drawing Sheets

(51) Int. Cl.

| | |
|---|---|
| ***E05F 3/16*** | (2006.01) |
| ***E05F 3/20*** | (2006.01) |
| ***E05D 15/30*** | (2006.01) |
| ***E05F 3/14*** | (2006.01) |

(52) U.S. Cl.
CPC ..... *E05F 3/16* (2013.01); *E05F 3/20* (2013.01); *E05F 5/06* (2013.01)

(58) Field of Classification Search
USPC ..... 74/30, 89.18, 89.17, 89.11, 109, 131, 74/133, 134
See application file for complete search history.

(56) References Cited

U.S. PATENT DOCUMENTS 5,189,923 A * 3/1993 Lashbrook ..... F15B 15/065 74/409
5,522,485 A * 6/1996 Takahashi ..... F16F 9/12 188/290
5,582,070 A * 12/1996 Dominguez ..... F16H 19/04 192/143
8,925,411 B2 * 1/2015 Lee ..... F16H 19/04 74/409
2005/0196217 A1 9/2005 Nishimura et al.
2007/0000742 A1 * 1/2007 Cultraro ..... E05C 19/022 188/290
2008/0025749 A1 * 1/2008 Igarashi ..... G03G 21/1633 399/92
2009/0010697 A1 1/2009 Nishimura et al.
2009/0022516 A1 1/2009 Ohta et al.
2009/0175648 A1 * 7/2009 Tsuchiya ..... G03G 21/1633 399/107
2011/0058847 A1 * 3/2011 Furuichi ..... G03G 21/16 399/110
2011/0158680 A1 * 6/2011 Koiwai ..... G03G 21/1633 399/110
2011/0182614 A1 * 7/2011 Onuma ..... G03G 21/1633 399/110
2012/0163857 A1 * 6/2012 Kamimura ..... G03G 21/1633 399/110
2013/0251396 A1 * 9/2013 Shikata ..... G03G 21/1633 399/110
2015/0160601 A1 * 6/2015 Namba ..... H04N 1/00 312/326
2016/0039624 A1 * 2/2016 Abe ..... G03G 21/1633 399/110
2016/0098007 A1 * 4/2016 Doi ..... G03G 21/1633 49/394

FOREIGN PATENT DOCUMENTS

JP 2003-241466 A 8/2003
JP 2006-83551 A 3/2006
JP 2007-279274 A 10/2007
JP 4923683 A 4/2012

OTHER PUBLICATIONS

U.S. Appl. No. 14/867,249, filed Sep. 28, 2015, Shigeo Doi Tadahisa Sugiyama.

* cited by examiner

IMAGE FORMING APPARATUS HAVING A DAMPER UNIT WHICH REGULATES MOVEMENT OF A DOOR UNIT

BACKGROUND OF THE INVENTION

Field of the Invention

The present invention relates to an image forming apparatus which includes an opening/closing unit provided to be freely opened or closed.

Description of the Related Art

In recent years, there are various proposals for enhancing operability of portions that a user operates for the purpose of improving a quality of an image forming apparatus. Among them, in a so-called door portion which is provided as a part of the outer case of the image forming apparatus, in order to handle trouble-shooting in the event of a problem, such as a jam occurrence, an impact buffering portion is provided to buffer an impact generated at a time when the door is opened up to a predetermined opening position and stopped by a stopper member. There is a proposal to prevent damage to a main body of the image forming apparatus or to the door, caused by the impact generated when the door is opened, while maintaining good operability for the user.

Specifically, the following proposal is made for the impact buffering portion for such an opening/closing operation of the door.

First, an opening/closing mechanism of a cover of the image forming apparatus disclosed in Japanese Patent Laid-Open No. 2006-83551 is provided with an arc groove having a gear portion disposed therein, in a vicinity of a rotation center of the opening/closing mechanism, and includes a gear which is meshed with the gear portion inside the groove and which can be freely rotated. In the gear, a rotary damper is included in a rotating axial direction, and a control force (load) is applied during an operation of opening or closing the cover. In this way, an impact generated when the opening/closing operation of the cover ends is buffered by applying the control force.

Next, in Japanese Patent Laid-Open No. 2007-279274, a load is applied to the opening/closing door by a rack and an oil damper which control the rotation of a pinion. In addition, the pinion and the rack are configured to be separated in an operation where the damper effect is not required.

On the other hand, there is an image forming apparatus in which a plurality of opening angles is set in one door. The plurality of opening angles are generally set as an opening angle for trouble-shooting performed by the user, and as an opening angle for regular replacement of components, or replacement of units, which is performed by a maintenance manager, such as a so-called service man.

In other words, as a main trouble handling performed by the user, a process of removing a jammed sheet caused by a jam occurrence, or other sheets remaining in the image forming apparatus, is exemplified. In this case, the door may be opened only by an amount sufficient for removing the jammed sheet. However, in a case where the maintenance manager replaces components or units, in the course of regular maintenance, using the opening portion of the same door, a switching portion is configured to perform a switching operation to open the door to a greater degree than a case in which the jam recovery is performed, in order to ensure the door opens smoothly without causing damage in the process of replacing components or units.

In Japanese Patent Laid-Open No. 2003-241466, there is provided a regulation portion which regulates the door, to be opened at a plurality of opening angles, according to a usage, such as an opening position for the jam recovery performed by the user, and an opening position for the maintenance performed by the manager, such as a service man. Furthermore, in a case where the door is opened up to the opening position for the jam recovery, among a plurality of opening positions, a load is applied to the movement of the door before the door reaches the opening position, and an impact generated when the door is stopped is buffered. However, it is desired to minimize the apparatus for applying the load to the movement of the door.

SUMMARY OF THE INVENTION

In an image forming apparatus provided with an opening/closing unit, it is desirable to minimize an apparatus which applies a load to a movement of the opening/closing unit.

In order to achieve the above object, an image forming apparatus comprising: a main body of the image forming apparatus; an opening/closing unit that is provided to be opened or closed with respect to the main body; and a loading portion that applies a load on a movement of the opening/closing unit, wherein the loading portion includes a rotating member, a damper unit that applies a load to a rotation of the rotating member, and an arm portion that is engaged with the rotating member to cause the rotating member to be rotated according to the movement of the opening/closing unit, wherein a load of the damper unit is applied to the moving opening/closing unit by engaging the arm portion with the rotating member, wherein the arm portion includes a first arm member that includes a first engagement portion to be engaged with the rotating member, and a second arm member that includes a second engagement portion to be engaged with the rotating member when the opening/closing unit is opened larger than a position of the opening/closing unit where the rotating member and the first arm member are engaged, and is provided to be movable with respect to the first arm member, and wherein the first arm member and second arm member move relatively to each other in conjunction with an opening/closing operation of the opening/closing unit.

Further features of the present invention will become apparent from the following description of exemplary embodiments with reference to the attached drawings.

DESCRIPTION OF THE EMBODIMENTS

An image forming apparatus according to embodiments of the invention will be described in detail as an example with reference to the drawings. Further, dimensions, materials, and relative positions of components of the image forming apparatus described in the following embodiments are not intended to limit a scope of the invention if not otherwise specified.

Figure 1:
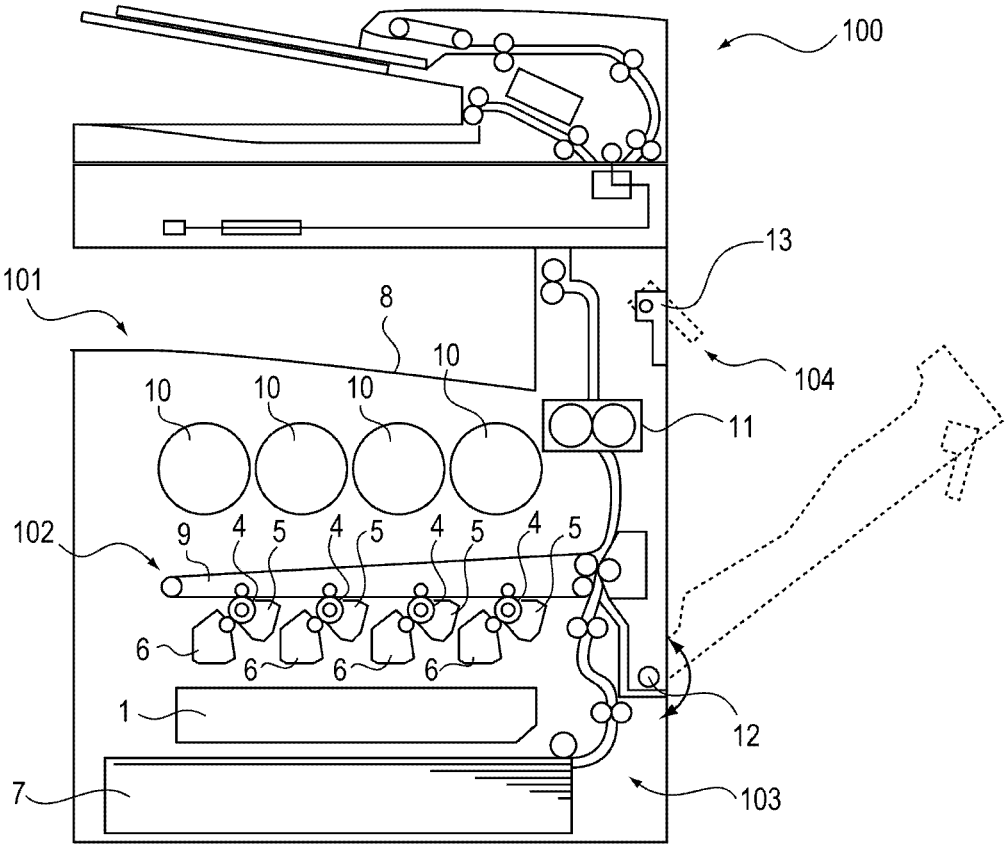
FIG. 1 is a diagram schematically illustrating an image forming apparatus which includes an opening/closing unit.

First, the image forming apparatus which includes an opening/closing unit according to the present embodiment will be described using FIG. 1. FIG. 1 is a diagram schematically illustrating a configuration of the image forming apparatus which includes the opening/closing unit of this embodiment.

As illustrated in FIG. 1, an image forming apparatus 100 serves to perform image formation using an image forming portion 102 to form an image on a sheet sent by a sheet feeding device 103 stored in a main body 101.

The image forming portion 102 includes a drum unit 5, a developing unit 6, and an intermediate transfer belt unit 9. The drum unit 5 includes a photosensitive drum 4 which forms an electrostatic latent image by an exposure device 1 where a light beam is emitted based on image data. The developing unit 6 supplies the toner sent by a toner bottle 10 onto the photosensitive drum 4 so as to develop the electrostatic latent image. The intermediate transfer belt unit 9 transfers the toner image formed on the photosensitive drum 4. The drum unit 5, the developing unit 6, and the intermediate transfer belt unit 9 are configured to be detachably attachable to the main body 101 for the purpose of the jam recovery in the main body 101 and maintenance/replacement of inner mechanisms.

A sheet conveyance path is configured such that the sheet is fed from the sheet feeding device 103, a toner image is formed on the sheet as it passes through the image forming portion 102, a fixing device 11 permanently fixes the toner image transferred on the sheet, and the sheet is discharged to a discharge tray 8 on the outside of the main body 101.

In the image forming apparatus of this embodiment, the drum unit 5 and the developing unit 6 in the image forming portion 102, the toner bottle 10, and a sheet cassette 7 are configured to be inserted or removed from a front surface side of the main body 101. On the other hand, the fixing device 11 and the intermediate transfer belt unit 9 in the image forming portion 102 are configured to be inserted or removed by opening a door unit 104 of a side surface of the main body 101. In addition, the process of removing a jammed sheet is mainly performed by opening the door unit 104. Further, the front surface of the image forming apparatus is a surface of the apparatus when viewing the image forming apparatus from a front side, as illustrated in FIG. 1. Regarding the side surface, the surface on the right side, when viewing the image forming apparatus from a front side as illustrated in FIG. 1, is the right surface, and the surface on the left side is the left surface.

In addition, the door unit 104 is an opening/closing unit which is provided to be freely opened or closed with respect to the main body 101 and provided with a plurality of opening positions different in opening angles. The door unit 104 is provided in one side surface (herein, the right surface where the sheet conveyance path is provided) of the main body 101, axially supported by a shaft 12 disposed in the lower portion of the main body 101, and provided to be freely rotated about the shaft 12. Furthermore, a holding portion 13 is provided in the door unit 104 to help an operator to freely open or close the door unit. At the time of the jam recovery or the maintenance of the inner mechanisms, the operator holds the holding portion 13 and turns the door unit 104 in the right direction with respect to the main body 101 to be rotated about the shaft 12, and thus can expose the inner portion of the main body for the access thereto.

Figure 2:
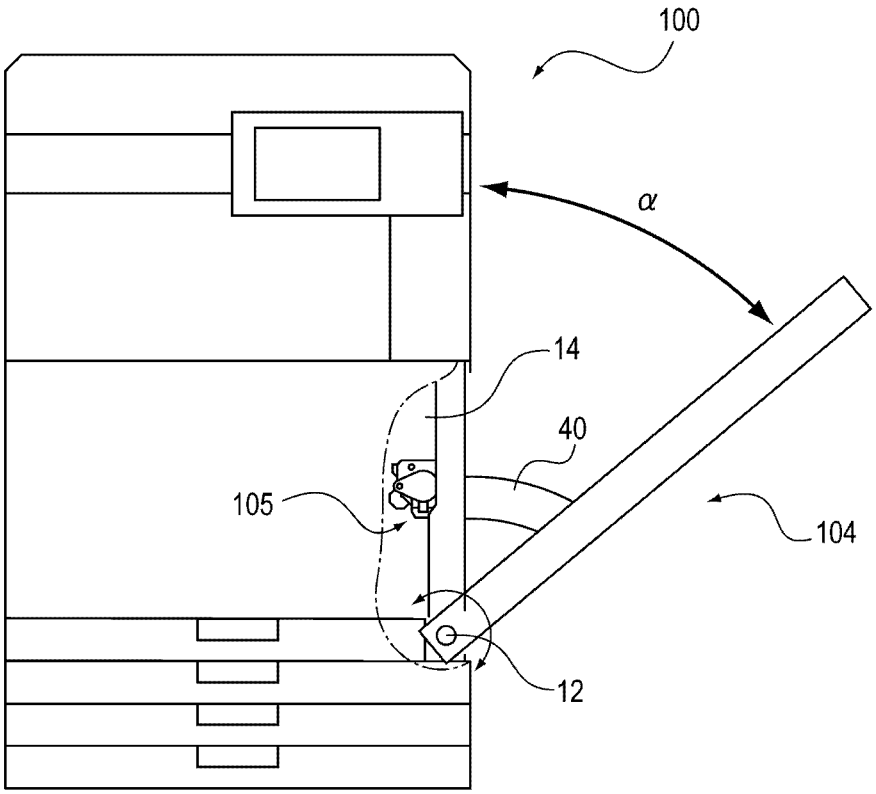
FIG. 2 is a diagram schematically illustrating the image forming apparatus which includes the opening/closing unit.
Figure 3:
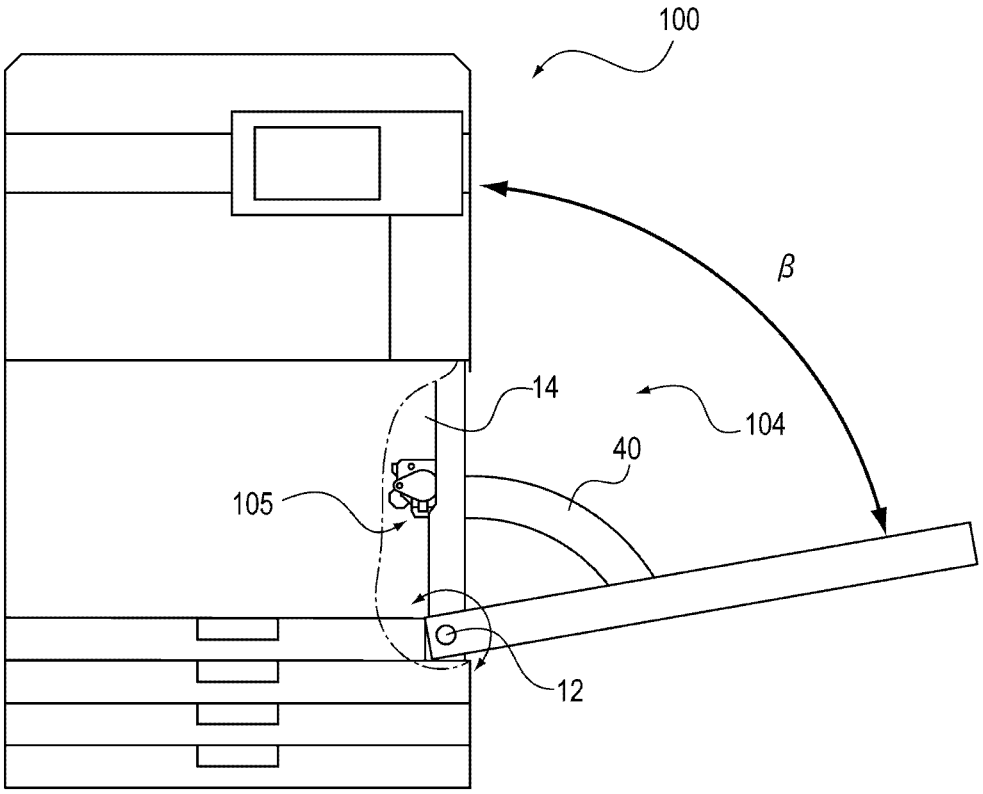
FIG. 3 is a diagram schematically illustrating the image forming apparatus which includes the opening/closing unit.

FIGS. 2 and 3 are schematic diagrams of the image forming apparatus 100 when the door unit 104 is opened, in which a schematic view of a portion taken in the vicinity of a damper mechanism in the main body is illustrated.

In the door unit 104, a rack 40 is provided as an arm portion which serves as an impact buffering portion to be described later. The rack 40 provided in the door unit 104 moves along the rotation direction of the door unit 104 about the shaft 12. At this time, the rack 40 is configured to move in the engagement state with a pinion 23 (serving as a rotating gear) to which a rotary damper 22 is attached, as illustrated in FIG. 4, in a damper unit 105 disposed in a main frame 14 (a component of the main body 101), and which performs a damper function.

Figure 4:
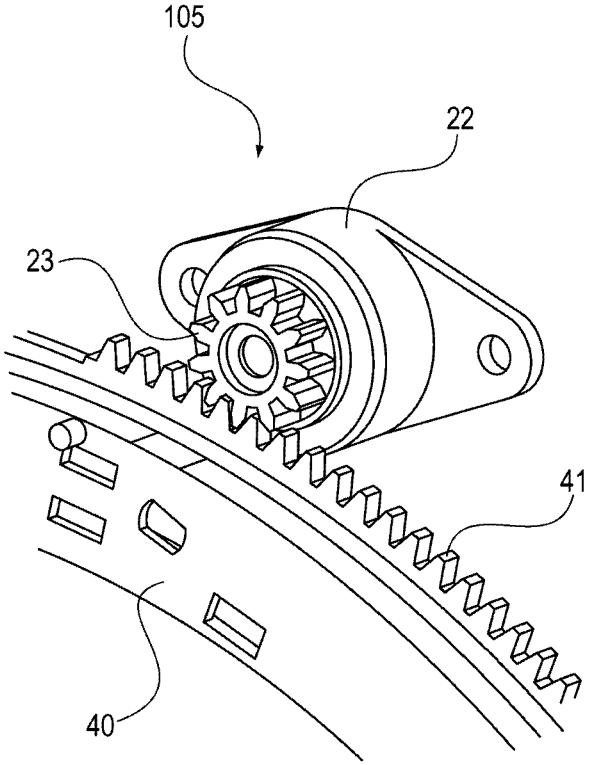
FIG. 4 is a diagram schematically illustrating an engagement state between a pinion and a rack where a rotary damper is attached.
Figure 5:
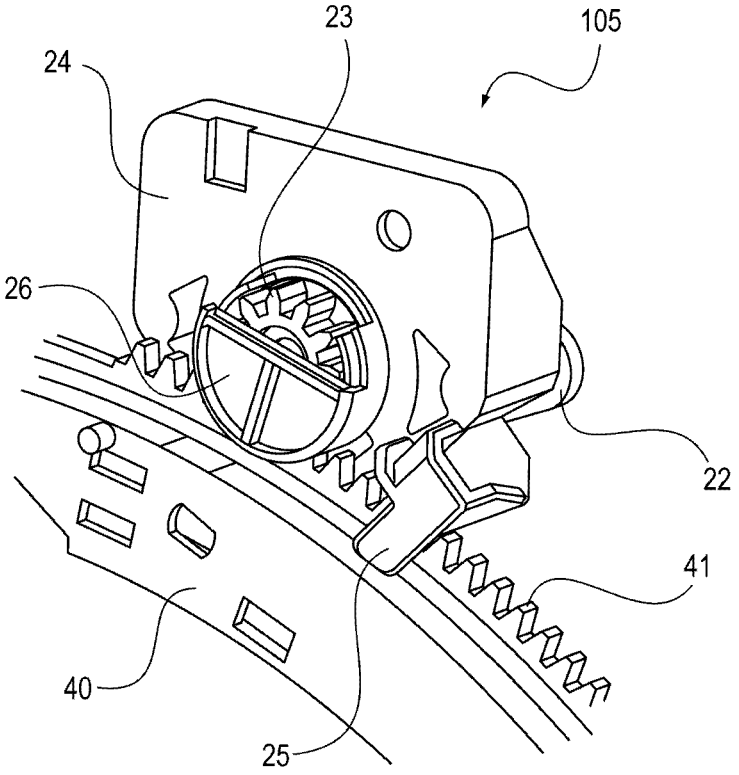
FIG. 5 is a diagram schematically illustrating a configuration for maintaining the engagement state between the pinion and the rack.

In addition, FIGS. 4 and 5 illustrate a detailed configuration of the damper unit 105. FIGS. 4 and 5 are perspective views illustrating the damper unit 105 disposed in the main body and a part of the rack 40 engaged with the pinion 23 of the damper unit 105.

As illustrated in FIGS. 4 and 5, the damper unit 105 and the rack 40 form an impact buffering portion which buffers an impact on at least one opening position of an opening/closing unit having a plurality of opening positions at different opening angles. The damper unit 105 serving as a loading portion which applies a load on the movement of the door unit 104 includes the rotary damper 22 attached to the pinion 23 serving as a rotating member having a gear portion on the outer periphery, and a damper holder 24 serving to attach these components to the main frame 14.

In the damper holder 24, a rack disengagement prevention member 25 and a rack thrust displacement prevention member 26 are provided in order to stabilize the engagement between the pinion 23 and a gear portion 41 of the rack 40. With this configuration, the rack 40 moves in a rotating axial direction of the pinion 23, and the engagement between the pinion 23 and the gear portion 41 of the rack 40 is prevented from being released.

Figure 7:
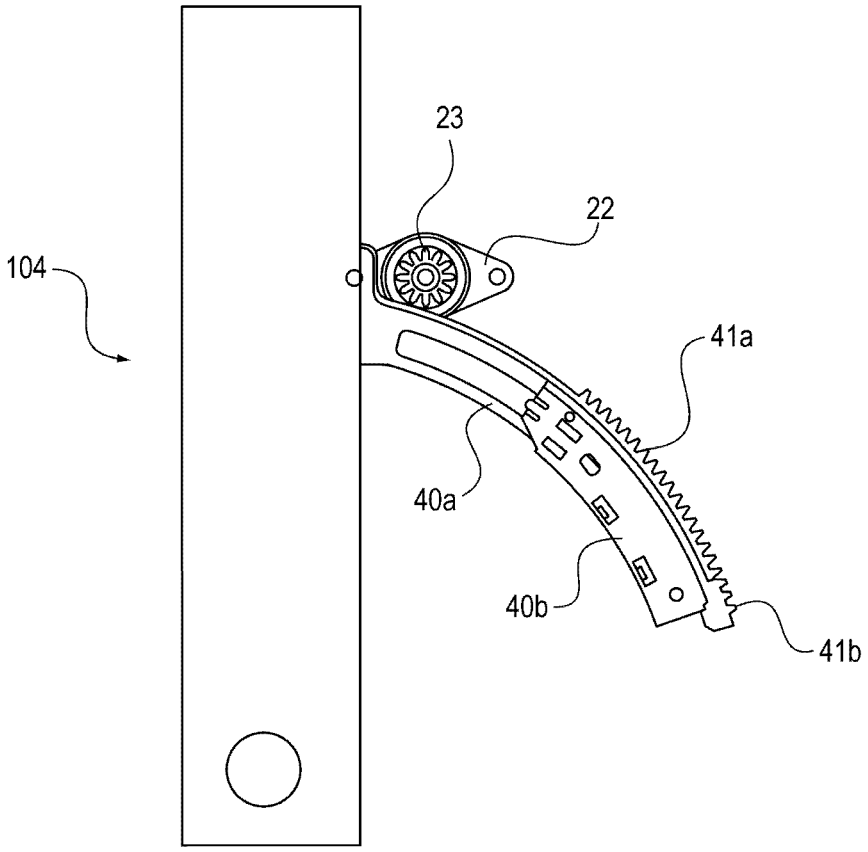
FIG. 7 is a diagram schematically illustrating a state where a door is closed.
Figure 8:
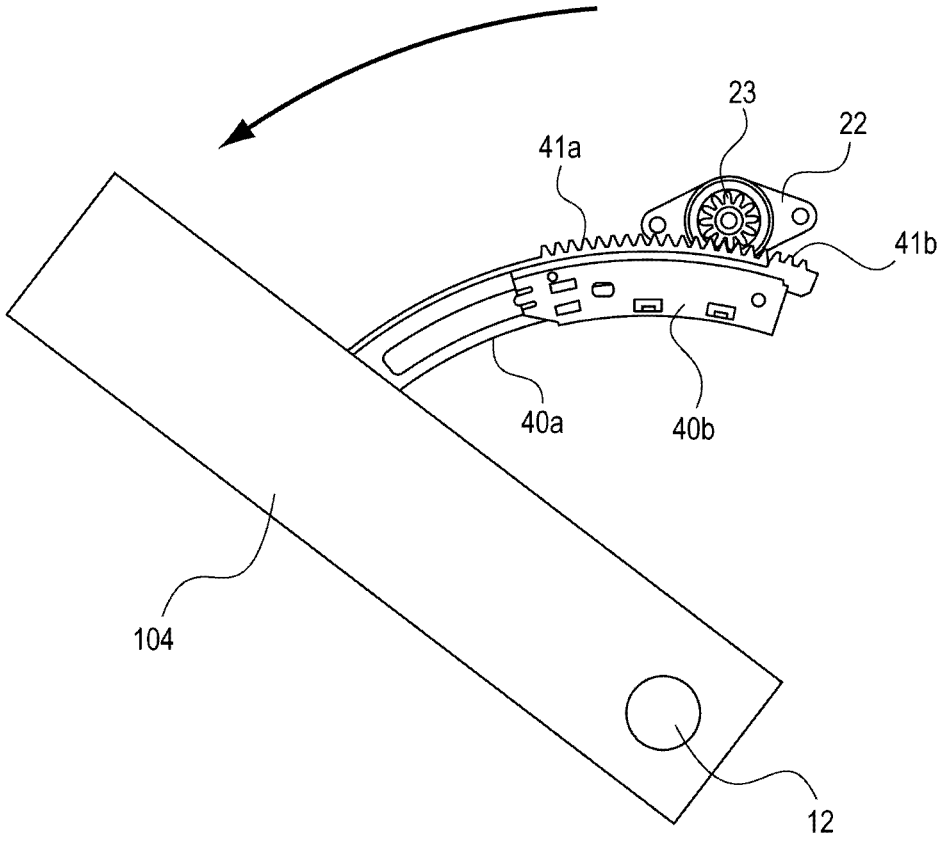
FIG. 8 is a diagram schematically illustrating an opened state where the door is opened up to a first opening position.

The rack of the image forming apparatus in this embodiment will be specifically described using FIGS. 7 and 8.

As illustrated in FIGS. 7 and 8, the rack 40 includes a fixed portion (a first arm member) **40*a* which is fixed to the door unit 104, and a slide portion (a second arm member) 40*b* which is attached to freely slide within a specified range in an arc direction with respect to the fixed portion 40*a*. A fixed portion gear 41*a* serving as a first engagement portion to be meshed with the pinion 23 is provided in a part of the fixed portion 40*a* serving as a rack member. A slide gear 41*b* serving as a second engagement portion to be meshed with the pinion 23 is also provided in a part of the slide portion 40***b*. In other words, in the rack 40, the gear portion 41 serving as an engagement portion to be meshed with the pinion 23 includes the fixed portion gear 41*a* which is provided in a part of the fixed portion 40*a*, and the slide gear 41*b* which is provided in a part of the slide portion 40*b*. The slide portion 40*b* serving as the slide member is extended in an arrangement direction of teeth of the fixed portion gear 41*a*.

During a closing operation of the door unit 104, the fixed portion gear 41*a* is disposed to be meshed with the pinion 23 from a position that is close to or at a first opening position at an angle of α, as illustrated in FIG. 2, to a state where the door unit 104 is closed, as illustrated in FIG. 7. During an opening operation of the door unit 104, the fixed portion gear 41*a* is disposed to be meshed with the pinion 23 from a position at which the door unit 104 is initially opened up from a closed position, to the first opening position at the angle of α. FIG. 8 illustrates the state where the door unit 104 is opened up to the first opening position at the angle of α. In other words, in the image forming apparatus of this embodiment, the fixed portion gear 41*a* is set to be meshed with the pinion 23 within a predetermined range up to and including the first opening position. Herein, the opening angle of α=45° (not particularly limited) of the first opening position is mainly assumed to be the opening angle of the door unit 104 when a user performs the jam recovery. That is, the fixed portion gear 41*a* is set to be meshed with the pinion 23 from just before a position at an angle of about 20°, and remains meshed with the pinion 23 until the door unit 104 is opened up to the opening angle α, at which point a stopper function (not illustrated) is used to buffer the impact caused when the door unit 104 is stopped at the first opening position due to the damper function (i.e., resistive load) of the damper unit 105. One of the purposes of buffering the impact is to satisfy the user with the comfortability during the operation. Another purpose of buffering the impact is to avoid breakage to the door itself due to the impact, or the deformation of the components in the main body (specifically, the main frame 14) when the user releases his/her own hand in the middle of opening the door, or when the door is opened with a force exceeding an expected load.

In addition, in the state where the door unit 104 is almost closed, the fixed portion gear 41*a* is set not to be meshed with the pinion 23. That is, in order to avoid a situation in which an opening operation is difficult for the user due to a load of the rotary damper 22, and to make the operation easy, the fixed portion gear 41*a* and the pinion 23 do not mesh when the door unit 104 is in a closed or almost closed state. When the door unit 104 begins to be opened, the weight of the door itself has minimal effect in the opening direction. Therefore, if the fixed portion gear 41*a* is meshed with the pinion 23 in the state where the door unit 104 begins to be opened, a rotary load of the rotary damper 22 is dominant and acts as a load on the user who performs the opening operation. In order to avoid such a situation, in the state where the door unit 104 is almost closed, the fixed portion gear 41*a* is set not to be meshed with the pinion 23. Furthermore, due to a balance between the weight of the door itself and the rotary load of the rotary damper 22, in a case where the rotary load of the damper is applied when the door is slightly opened, the door unit 104 may be stopped, even though the door unit is not at a predetermined opening position yet, when the user releases his/her own hand. Therefore, by virtue of the above configuration, it is possible to improve operability, and also to avoid such a situation in which a user has difficulty opening the door unit 104.

Figure 9:
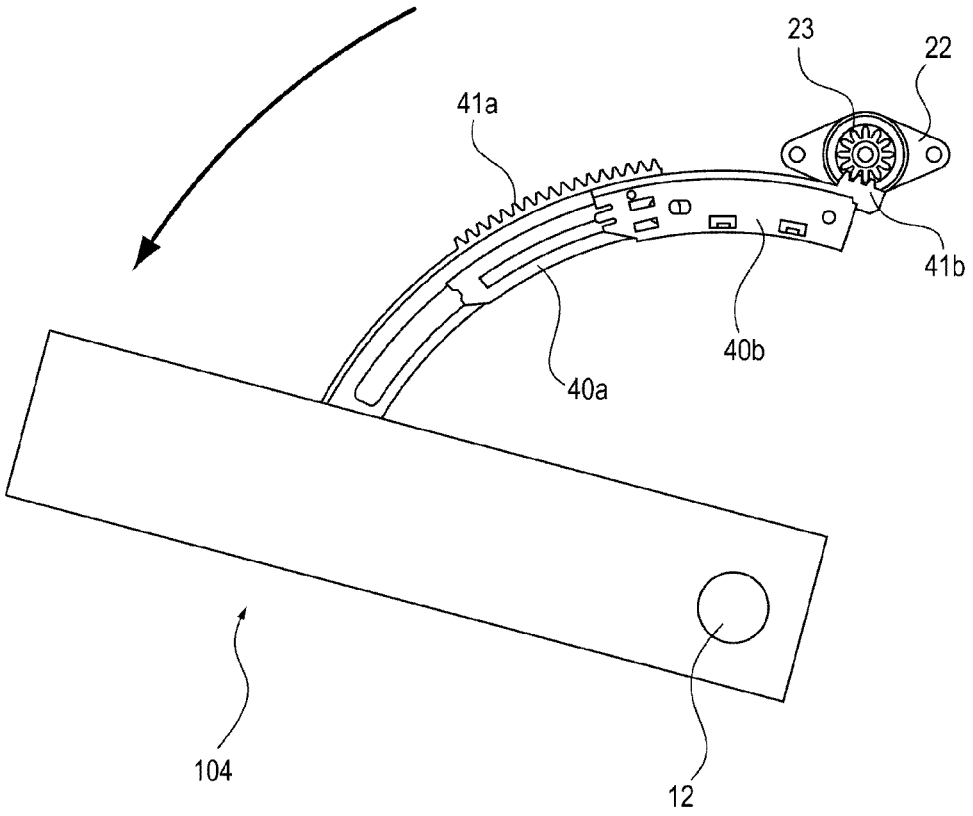
FIG. 9 is a diagram schematically illustrating a state where the door is opened up to a second opening position.

The slide gear 41*b* is disposed at a position where the slide gear is continuously connected to the fixed portion gear 41*a* in a state where the rack 40 is fully folded, as illustrated in FIG. 7. In the image forming apparatus of this embodiment, the number of teeth of the slide gear 41*b* is three (not particularly limited). In a case where the stopper function (not illustrated) is released and the door unit 104 is opened further at the time of maintenance, the slide gear 41*b* is meshed with the pinion 23. Therefore, the pinion 23 is not rotated due to the rotary load of the rotary damper 22, and the movement of the slide portion 40*b* is restricted. Then, the fixed portion 40*a*, having the fixed portion gear 41*a* which is released from the meshing with the pinion 23, slides in a circumferential direction relative to the slide portion 40*b*, of which the movement is restricted. Therefore, the rack 40 enters an extending state as illustrated in FIG. 9. FIG. 9 illustrates a state where the door unit 104 is opened up to a second opening position at an angle of β larger than the opening angle α. The amount of sliding of the fixed portion 40*a* with respect to the slide portion 40*b* is appropriate to an extent that the slide gear 41*b* is kept in meshing with the pinion 23 in a state where the door unit 104, illustrated in FIG. 2, is opened from the angle α up to the angle β, as illustrated in FIG. 3. In the image forming apparatus of this embodiment, since the meshing area of the fixed portion gear 41*a* is set up to about 50° at the opening angle β=75° (not particularly limited) of the second opening position, the remaining 25°+[Margin] becomes the sliding amount of the fixed portion 40*a* with respect to the slide portion 40*b*.

In addition, as described above, when the door unit 104 is opened or closed, the purpose of extending or folding the rack 40 in conjunction with the opening/closing operation is as follows.

First, in a case where the rack 40 is not extended or folded, for example, a long rack having the length at the time when the rack 40 is extended is employed, there is a need to prepare a space for storing the long rack when the door unit 104 is closed. In the image forming apparatus of this embodiment, since the damper unit 105 is disposed in the front side of the apparatus, the position of the long rack in the state where the door is closed enters a movement area of the sheet cassette which is inserted or removed with respect to the front of the main body and the drum unit, or the developing unit on the most right side. Therefore, in this case, when a sheet is replenished to the sheet cassette, or when the drum unit or the developing unit is maintained, the door on the right side should be opened on purpose.

In contrast, when the rack is set only to be the length corresponding to the first opening position at the angle of α, illustrated in FIG. 2 (a state where there is no slide portion 40*b*), the meshing operation between the pinion and the rack is necessary when the door is closed from the second opening position at the angle of β, illustrated in FIG. 3, having a large opening angle. At this time, since the initial position where the pinion is meshed with the rack at the beginning of a closing operation is a position farthest away from the position at which the door is closed, the rack itself may be bent in an axial direction of the pinion if the rack does not have a sufficient rigidity, and it is possible that the gears are not easily meshed. In addition, due to the attaching position of the rack, it may be difficult for the operator to support the door with his/her hand in order to make the gears meshed in the main body.

In order to cope with these problems, as described above, when the door unit 104 is opened or closed, the rack 40 is extended or folded in conjunction with the opening/closing operation. According to this embodiment, as described above, since the rack 40 is extended or folded in conjunction with the opening/closing operation of the door unit 104, the retreating space for the rack 40 in the apparatus can be made small while keeping the engagement between the pinion 23 and the gear portion 41 of the rack 40.

Among the configurations of the image forming apparatus described above, in a case where the rotary load is applied on both sides in the rotation direction of the rotary damper, the operation of the door unit 104 from the state where the door is opened up to the angle of β, relative to the closed state, is sequentially performed as illustrated in FIGS. 9, 8, and 7 in this order. Therefore, a detailed operation sequence will not be given herein.

However, in the rotary damper, an operating force for closing the door unit 104 is in a state where the rotary load of the rotary damper is added to the weight of the door. Therefore, the operability is not suitable.

Then, the image forming apparatus of this embodiment employs the rotary damper 22 which is provided with a one-way function in order to apply the rotary load only at the time of opening the door unit 104. Making a simple description, the load is applied when the pinion 23 is rotated in the right direction in FIGS. 7, 8, and 9, but on the contrary there is applied almost no load when the rotation is made in the left direction. In other words, the load is applied to the rotary damper when the door unit is opened, but no load is applied to the rotary damper when the door unit is closed.

Figure 10:
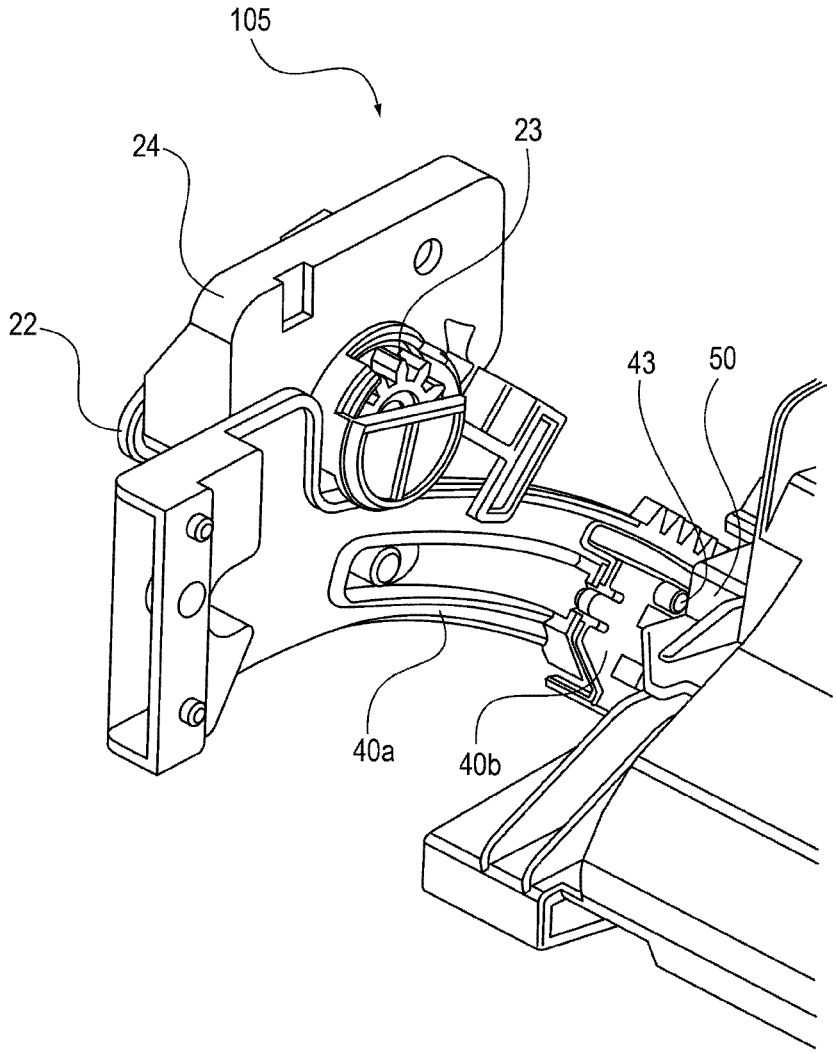
FIG. 10 is a diagram schematically illustrating a configuration for making the rack folded.
Figure 11:
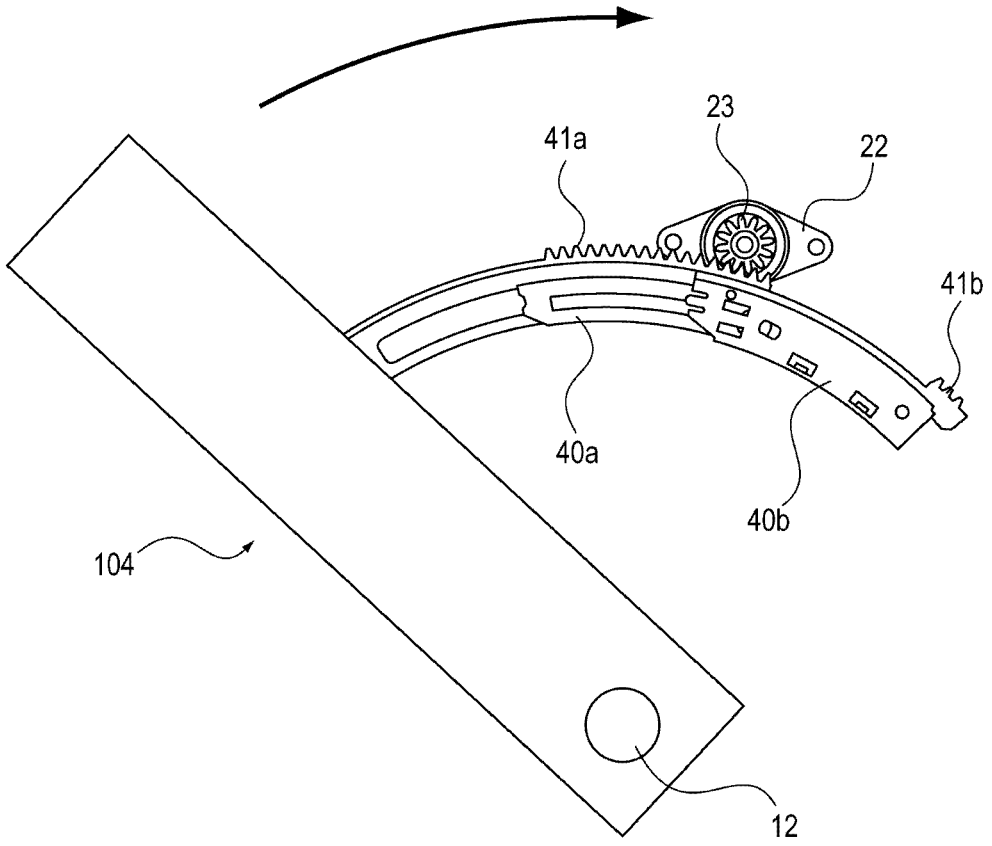
FIG. 11 is a diagram schematically illustrating a state where the door is closed up to a jam recovery position.
Figure 12:
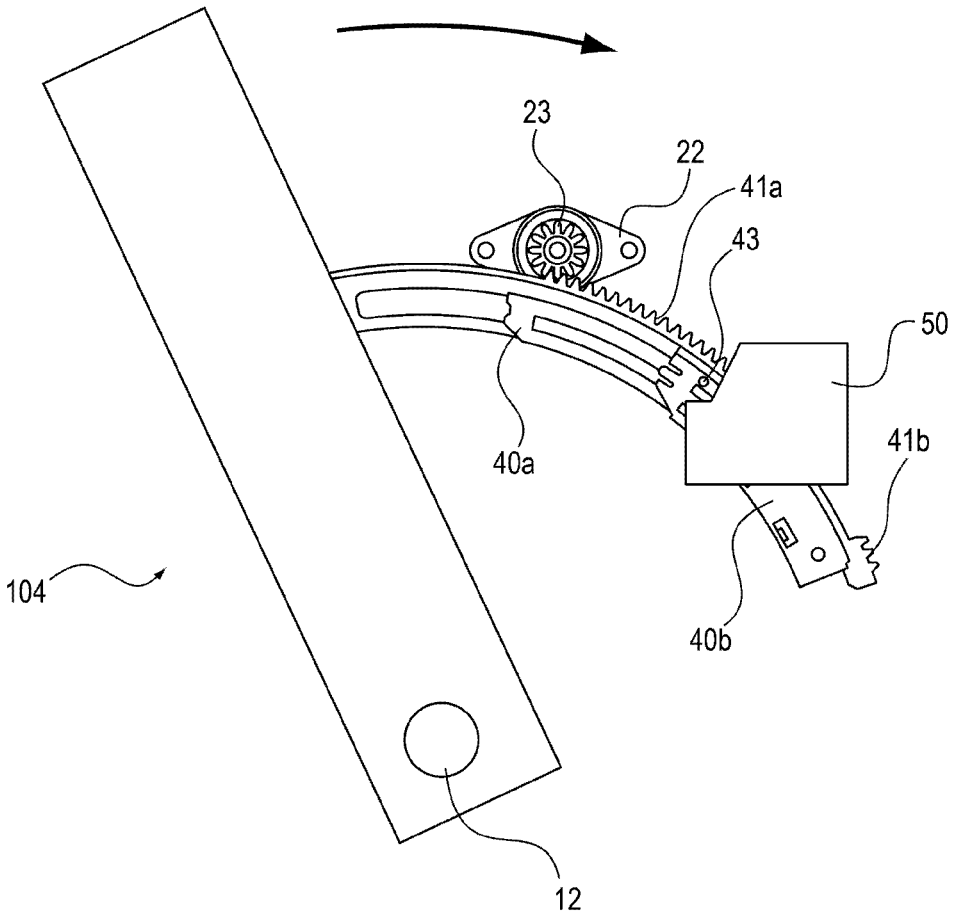
FIG. 12 is a diagram schematically illustrating a state where the rack begins to be folded when the door is being closed.
Figure 13:
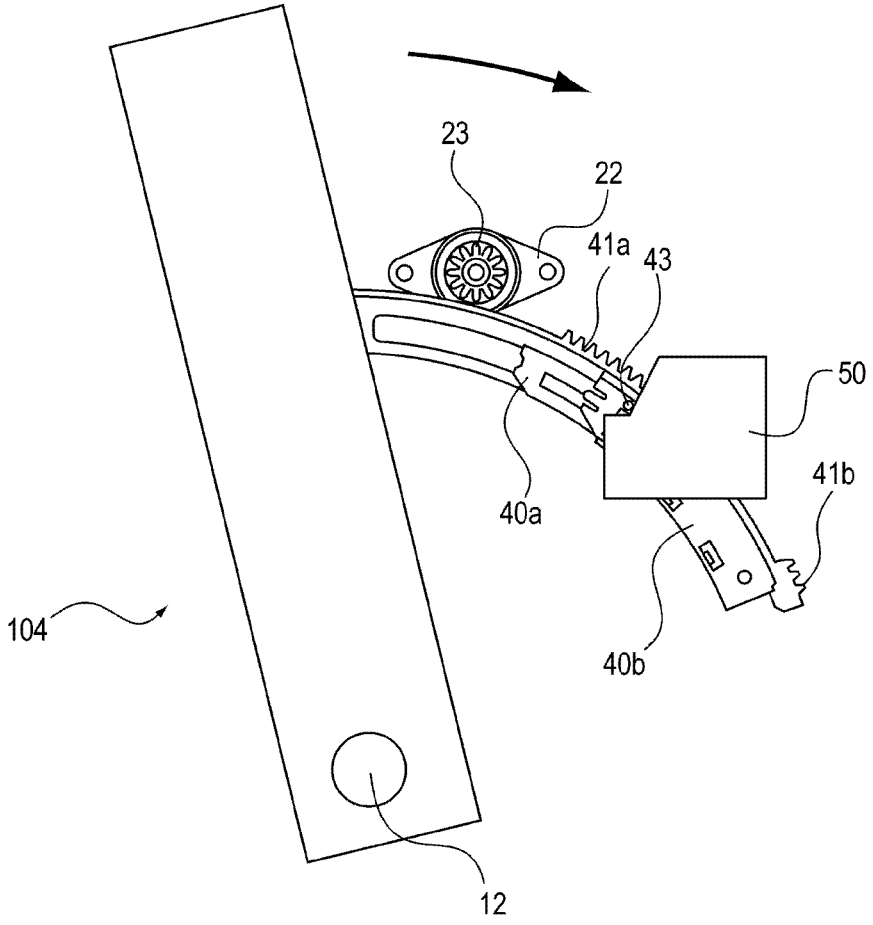
FIG. 13 is a diagram schematically illustrating a state where the rack is folded when the door is being closed.

When the above configuration is employed, a force is applied to the slide gear 41*b* in the operation from a state where the door unit 104 is opened up to the second opening position of the angle of β, relative to the closed state, but the pinion 23 is rotated under almost no load. Therefore, as illustrated in FIG. 11, the slide portion 40*b* is also rotated in the same direction together with the fixed portion 40*a*. The rack 40 in this extended state is necessarily shrunk again to the position where the slide gear 41*b* and the fixed portion gear 41*a* are continuously connected as illustrated in FIG. 7. Then, as illustrated in FIG. 10, a projection 43 is provided in a part of the slide portion 40*b*, and a stopper member 50 is provided to make the projection 43 abut on the main body. With this configuration, the projection 43 of the slide portion 40*b* during the operation of closing the door abuts on the stopper member 50 as illustrated in FIG. 12, so that the slide portion 40*b* does not move from the abutting position. Therefore, when the door unit 104 is moved closer to a closed position, the fixed portion 40*a* moves relative to the slide portion 40*b*, and the rack 40 enters a shrunk state as illustrated in FIG. 13, and can be stored compactly, as illustrated in FIG. 7.

Figure 6:
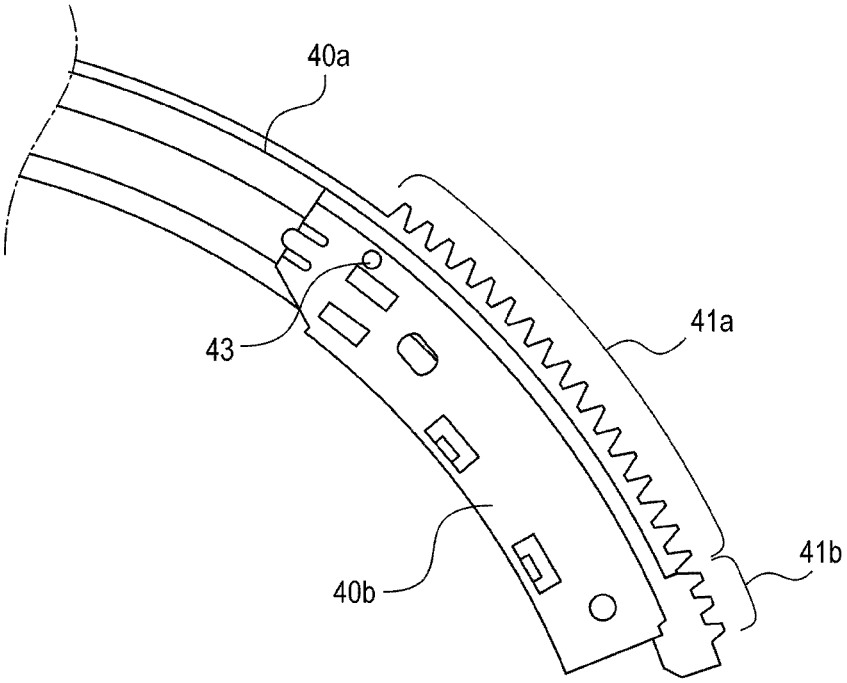
FIG. 6 is a diagram for schematically illustrating a configuration of the rack having a gear portion.
Figure 14:
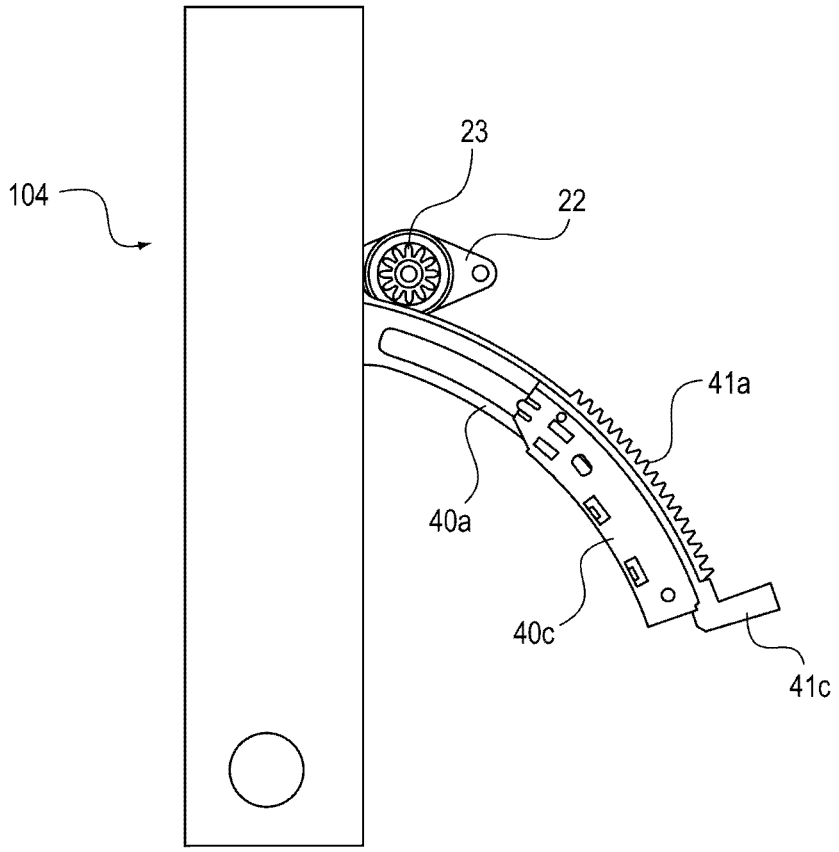
FIG. 14 is a diagram schematically illustrating a state where the door is closed.

In the configuration described hitherto, the configuration in which the slide gear 41*b* is provided as the slide portion 40*b*, as illustrated in FIG. 6, has been exemplarily described as a transfer portion which makes the rack transferred to an extended state, but the invention is not limited thereto. For example, as illustrated in FIG. 14, even when a hooking member 41*c* is be provided in the slide portion 40*b* as an engagement portion instead of the slide gear, the same effect can be obtained.

In this embodiment, the reason why the slide portion 40*b* illustrated in FIG. 6 is employed is that the pinion 23 and the rack 40 can be easily meshed at the second opening position at the time of maintenance, as illustrated in FIGS. 3 and 9, only by sliding the slide portion 40*b*. Specifically, in a case where the door unit 104 is assembled in the main body 101, a case where the components in the door unit 104 are attached or detached for the replacement, or a case where the door unit 104 is replaced, the pinion 23 and the rack 40 can be meshed only by sliding the slide portion 40*b*.

Furthermore, in the above-mentioned embodiment, the rack 40 is attached to the door unit 104, and the damper unit 105 containing the pinion 23 meshed with the rack 40 is attached to the main frame 14, but the invention is not limited thereto. For example, the damper unit 105 may be attached to the door unit 104, and the rack 40 may be attached to the main frame 14 as long as basic configurations of the rack 40 and the damper unit 105 are similar to each other. Even in this case, the same effect can be obtained.

In addition, in the above-mentioned embodiment, the gear portion meshed with the pinion is exemplified as an engagement portion of the arm portion, but the invention is not limited thereto. For example, there may be employed other configurations such as a configuration in which the rotating member is configured by a rubber roller, and an arc engagement portion to be engaged with the outer surface of the rubber roller with pressure is provided in the arm portion.

In addition, in the above-mentioned embodiment, the description has been made about the configuration in which the impact buffering portion of the door unit having the opening for attaching or detaching the intermediate transfer belt unit, but the invention is not limited thereto. Even when the invention is applied to the impact buffering portion of the opening/closing unit having an opening for attaching or detaching other units such as the sheet cassette, the drum unit, and the developing unit, the same effect can be obtained.

In addition, in the above-mentioned embodiment, the printer is exemplified as the image forming apparatus, but the invention is not limited thereto. For example, other image forming apparatuses such as a copying machine and a facsimile apparatus, or a multifunction peripheral in which these functions are combined may be applied. In addition, the invention is not limited to the image forming apparatus using an intermediate transfer member, but may be applied to an image forming apparatus which uses a recording material bearing member and transfers toner images of respective colors sequentially and in an overlapping manner onto the recording material carried in the recording material bearing member. The same effect can be obtained by applying the invention to the impact buffering portion of the opening/closing unit having an opening for attaching or detaching the unit in these image forming apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-209736, filed Oct. 14, 2014, which is hereby incorporated by reference herein in its entirety.

What is claimed is:

1. An image forming apparatus comprising:

a main body of the image forming apparatus;

a door unit that is provided to be opened with respect to the main body;

a loading portion that regulates movement of the door unit, the loading portion including:

a rotating member that is rotatable with the movement of the door unit; and a damper unit that applies a resistive load to the rotating member so as to regulate the rotation of the rotating member and to thereby regulate the movement of the door unit; and an arm portion provided on the door unit and projecting from the door unit in a predetermined direction, the arm portion comprising:

a first arm member (i) projecting from the door unit in the predetermined direction and (ii) including a first engagement portion engageable with the rotating member such that, when the first engagement portion is engaged with the rotating member, the rotating member rotates with the movement of the door unit, and a second arm member (i) supported by the first arm member (ii) moveable with respect to the first arm member in the predetermined direction and (iii) including a second engagement portion engageable with the rotating member, wherein, in a state in which the first arm member and the rotating member are not engaged with each other and the second arm member and the rotating member are engaged with each other, the second arm member is configured to move with respect to the first arm member so that a distance between a distal end of the arm portion and the door unit in the predetermined direction increases during an opening operation of the door unit.

2. The image forming apparatus according to claim 1, wherein the resistive load applied by the damper unit is applied to the rotating member and, via the arm portion, to the door unit by engagement between the first engagement portion and the rotating member during the opening operation of the door unit, and the arm portion is extended during the opening operation of the door unit by the first arm member moving relative to the second arm member when the second engagement portion and the rotating member are engaged.

3. The image forming apparatus according to claim 2, wherein the damper unit applies the resistive load to the rotating member during the opening operation of the door unit.

4. The image forming apparatus according to claim 1, wherein the second arm member includes a projection, and the main body includes a stopper member for abutting the projection, and wherein, during a closing operation of the door unit, the second arm member stops moving when the projection abuts the stopper member and the first arm member moves relative to the second arm member, thereby collapsing the arm portion.

5. The image forming apparatus according to claim 4, wherein the damper unit does not apply the resistive load to the rotating member during the closing operation of the door unit.

6. The image forming apparatus according to claim 1, wherein the first arm member is fixed to the door unit, and the damper unit is provided in the main body, and wherein during the opening operation of the door unit, the movement of the door unit is buffered by the resistive load of the damper unit applied to the door unit through engagement between the first engagement portion and the rotating member, and the first arm member is configured to move relative to the second arm member during the opening operation of the door unit when the second engagement portion and the rotating member are engaged.

7. The image forming apparatus according to claim 1, wherein the damper unit includes a prevention member to prevent disengagement of the rotating member and the first and second engagement portions.

8. The image forming apparatus according to claim 1, wherein the rotating member is a gear, and the first engagement portion is a rack member having a gear tooth portion that is meshed with the gear in a predetermined opening range of the door unit.

9. The image forming apparatus according to claim 8, wherein the second arm member includes a surface that is extendable in the predetermined direction.

10. The image forming apparatus according to claim 1, wherein the first arm member is adapted to move relative to the second arm member during a closing operation of the door unit.

11. The image forming apparatus according to claim 1, wherein the resistive load of the damper unit is applied to the rotating member and, via the arm portion, to the door unit by engagement between the first engagement portion and the rotating member during the opening operation of the door unit, and the resistive load of the damper unit is not applied to the door unit when the second engagement portion and the rotating member are engaged.

12. The image forming apparatus according to claim 1, wherein the arm portion extends and retracts along the predetermined direction, the predetermined direction extending along an arc.

13. An image forming apparatus comprising:

a main body of the image forming apparatus;

a door unit that is provided to be opened with respect to the main body;

a gear that is disposed in the main body;

a rack member (i) disposed on the door unit (ii) extending in a predetermined direction, and (iii) including a gear tooth portion configured to engage with the gear, the rack member being configured to move with movement of the door unit and rotate the gear;

a damper unit that applies a resistive load to the gear to resist rotation of the gear and to thereby regulate the movement of the rack member and the movement of the door unit; and a slide member that is disposed in the rack member to be movable relative to the rack member so that a projection amount of the slide member from a distal end of the rack member in the predetermined direction is changeable, wherein in a state in which the gear tooth portion of the rack member and the gear are not engaged, the slide member is configured to move with respect to the rack member so as to increase the projection amount of the slide member from the distal end of the rack member in the predetermined direction according to an opening operation of the door unit.

14. The image forming apparatus according to claim 13, wherein the slide member includes an engagement portion to be engaged with the gear, and wherein, when the slide member and the gear are engaged with each other, the slide member is configured to move with respect to the rack member so as to increase the projection amount of the slide member from the distal end of the rack member in the predetermined direction according to the opening operation of the door unit.

15. The image forming apparatus according to claim 14, wherein the damper unit applies the resistive load to the rack member via the gear to thereby resist the opening operation of the door unit.

16. The image forming apparatus according to claim 13, further comprising a stopper member, wherein during a closing operation of the door unit a part of the slide member abuts the stopper member to reduce the projection amount of the slide member from the distal end of the rack member.

17. The image forming apparatus according to claim 16, wherein the damper unit does not apply the resistive load to the rack member during the closing operation of the door unit.

18. The image forming apparatus according to claim 13, wherein the door unit is configured to rotate about a rotary axis, and the predetermined direction extends along an arc centered on the rotary axis.

19. The image forming apparatus according to claim 13, wherein the damper unit includes a prevention member to prevent the gear and from disengaging the gear tooth portion of the rack member.

20. The image forming apparatus according to claim 13, wherein the slide member is extendable along the predetermined direction.

21. The image forming apparatus according to claim 13, wherein the slide member includes an engagement portion configured to be engaged with the gear, and wherein the gear tooth portion of the rack member and the engagement portion move toward each other during a closing operation of the door unit.

* * * * *